US009957015B2

(12) United States Patent
Reden

(10) Patent No.: US 9,957,015 B2
(45) Date of Patent: May 1, 2018

(54) COVER SYSTEM

(71) Applicant: Gregory S. Reden, Escondido, CA (US)

(72) Inventor: Gregory S. Reden, Escondido, CA (US)

( * ) Notice: Subject to any disclaimer, the term of this patent is extended or adjusted under 35 U.S.C. 154(b) by 0 days. days.

(21) Appl. No.: 15/224,288

(22) Filed: Jul. 29, 2016

(65) Prior Publication Data

US 2016/0332702 A1 Nov. 17, 2016

Related U.S. Application Data

(63) Continuation-in-part of application No. 13/907,829, filed on May 31, 2013, now abandoned.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361; 52/2.11
See application file for complete search history.

(56) References Cited

U.S. PATENT DOCUMENTS

| | | | | |
|---|---|---|---|---|
| 3,651,847 A * | 3/1972 | Casamassima | A45B 23/00 190/1 |
| 4,768,457 A * | 9/1988 | Jones | B63B 17/02 114/361 |
| 6,286,449 B1 * | 9/2001 | Giffin | B63B 17/02 114/361 |
| 2004/0035034 A1 * | 2/2004 | Quade | E04H 15/20 40/610 |
| 2007/0087142 A1 * | 4/2007 | Irvine | A47G 33/06 428/34.1 |
| 2008/0276545 A1 * | 11/2008 | Publicover | E04H 15/20 52/2.11 |

* cited by examiner

*Primary Examiner* — Lars A Olson
(74) *Attorney, Agent, or Firm* — Todd J. Langford; Greenspoon Marder LLP

(57) ABSTRACT

A cover system for protecting boats, vessels, and other various shaped vehicles and objects is disclosed. A plurality of separate and distinct inflatable bladders supports a cover whereby a dome-like shape is produced. The resulting shape of the cover resists pooling of water and snow thereby reducing or even eliminating water damage to the underlying structure. Furthermore, since each bladder is separate and distinct, the plurality of bladders creates a support structure that conforms to objects of various shapes and sizes.

9 Claims, 5 Drawing Sheets

COVER SYSTEM

CROSS REFERENCE TO RELATED APPLICATIONS

This application is a continuation-in-part of U.S. patent application Ser. No. 13/907,829 filed on May 31, 2013, the entirety of which is hereby incorporated by reference.

BACKGROUND OF THE INVENTION

Field of the Invention

This invention relates to the general field of cover systems, and more specifically toward a cover system for protecting boats, vessels, and other various shaped vehicles and objects. A plurality of separate and distinct inflatable bladders supports a cover whereby a dome-like shape is produced. The resulting shape of the cover resists pooling of water and snow thereby reducing or even eliminating water damage to the underlying structure. Furthermore, since each bladder is separate and distinct, the plurality of bladders creates a support structure that conforms to objects Many boat owners store their boats during the winter season or when not in use. Often, this involves removing the boat from the water and placing a cover over the boat to protect it from the elements, especially when stored outside. Rain and snow then fall on the boat, which has only its cover for protection. If the cover fails, significant amounts of water and/or snow can inundate and flood the boat, causing significant damage such as rusting out and ruining the engine compartments and electrical systems, staining upholstery, and even mold. It has been said that faulty boat covers allowing water to leak into boats during the winter season cost over one billion dollars a year in damage to engines, electrical, and interiors. While part of the blame has been attributed to the owner's failure to remove the drain plug at end of summer, faulty covers remain a significant cause of the damage.

Prior art cover systems have implemented a covered wagon type system of arched poles that create a framework that supports a cover. These systems often require attaching a customized or semi-customized framework of metal or polyvinyl chloride (PVC) arched poles to the sides of the boat's interior or exterior. This results in unnecessary and wanted modifications to the structure of the boat. Furthermore, the arched poles do not stay in place and tend to collapse forward or backward. Another system uses an umbrella type framework with poles and straps to create a structure upon which the actual cover resides. A particular system uses a single pole in the middle of the boat, and the cover is pulled as taught as possible using straps to create a tent-like cover. The single pole and strap system result in holes in the cover where the top of the pole contacts the cover, thereby causing the cover to fail. Even if the cover does not fail where the pole meets the cover, water can collect and pool in areas without taut support. In many instances, it is a balance between creating a taut surface to resist the pooling of water and keeping the cover loose enough such that the pole does not puncture a hole in the cover. As one will appreciate, these prior art systems are very cumbersome and unreliable. The weight of rain and snow can sabotage these cover systems, especially after the wet cover begins to sag and stretch, repeated use, and heavy amounts of rain or snow.

Thus there has existed a long-felt need for a cover system that protects an underlying boat, vessel, or other structure or object, is easy to construct, resists pooling of rain and snow, and can withstand extended and repeated outdoor use.

SUMMARY OF THE INVENTION

The current invention provides a cover system for protecting boats, vessels, and other various shaped vehicles and objects. A plurality of separate and distinct inflatable bladders supports a cover whereby a dome-like shape is produced. The resulting shape of the cover resists pooling of water and snow thereby reducing or even eliminating water damage to the underlying structure. Furthermore, since each bladder is separate and distinct, the plurality of bladders creates a support structure that conforms to objects of various shapes and sizes.

It is a principal object of the invention to provide a cover system that resists the collection and pooling of rain, water, ice, and snow.

It is another object of the invention to provide a cover system that conforms to and protects structures of various shapes and sizes.

It is a further object of this invention to provide a cover system for a boat, ship, watercraft, and other vessels.

A particular embodiment of the current disclosure is a cover system for a vessel comprising a cover and a plurality of inflatable bladders, where the plurality of inflatable bladders provides support to the cover; and where the plurality of inflatable bladders comprises bladders of at least two sizes, where each size of bladder inflates to a different diameter, or the plurality of inflatable bladders consists of bladders with variable diameters, where the diameter of a bladder varies with the pressure within the bladder.

Another embodiment of the current disclosure is a method of covering a vessel comprising the steps of inflating a plurality of inflatable bladders; placing the plurality of inflatable bladders within a volumetric space of the vessel; and covering the vessel with a cover, wherein the cover is supported by at least one of the plurality of inflatable bladders. Furthermore, the embodiment may also include the steps of removing the cover; inflating one or more additional inflatable bladders; and placing the one or more additional inflatable bladders within the volumetric space of the vessel; and covering the vessel with the cover.

An additional embodiment of the current disclosure is a method of storing a vessel comprising the steps of inflating a plurality of inflatable bladders; placing the plurality of inflatable bladders within a volumetric space of the vessel; covering the vessel with a cover, wherein the cover is supported by at least one of the plurality of inflatable bladders; and storing the vessel for a period of time. Furthermore, the embodiment may also include the steps of removing the cover from the vessel; removing the plurality of inflatable bladders from within the volumetric space of the vessel; and deflating the plurality of inflatable bladders.

A further embodiment of the current disclosure is a method of storing a boat comprising the steps of inflating a plurality of inflatable bladders, wherein each of the plurality of inflatable bladders is spherical in shape; placing the plurality of inflatable bladders within a volumetric space of the boat; covering the boat with a cover, wherein the cover is supported by the plurality of inflatable bladders; storing the vessel for a period of time; removing the cover from the boat; removing the plurality of inflatable bladders from within the volumetric space of the boat; deflating the plurality of inflatable bladders; and placing the cover and plurality of inflatable bladders within a carrying case. The plurality of inflatable bladders comprises bladders of at least two sizes, where each size inflates to a different diameter. The method further comprises the steps of inflating a conical bladder, a pie-slice bladder, or a trapezoidal prism bladder; and placing the conical bladder in the bow of the boat before the step of covering the boat with a cover. The method further comprises the steps of inflating a rectangular prism bladder; and placing the rectangular prism bladder in the middle of the boat before the step of covering the boat with a cover. The method further comprises the steps of inflating a plurality of rectangular prism bladders; and placing the plurality of rectangular prism bladders in the boat before the step of covering the boat with a cover. Each of the plurality of rectangular prism bladders are placed on seats within the boat. Each of the plurality of inflatable bladders is inflated separately.

Yet another embodiment of the current disclosure is a boat cover system comprising a conical bladder, a larger rectangular prism bladder, a plurality of smaller rectangular bladders, a plurality of spherical bladders, and a cover; where each bladder is a separate volumetric space, where each bladder is not in fluid connection with another bladder, and where the bladders support the cover when within a boat, and where the cover encloses a volumetric space within the boat. The plurality of spherical bladders includes spherical bladders of at least two different sizes. The conical bladder is a pyramidal bladder. The plurality of smaller rectangular bladders is four smaller rectangular or cubic bladders.

An additional embodiment of the current disclosure is a method of storing a boat comprising the steps of inflating a rectangular prism bladder; placing the rectangular prism bladder in the middle of the boat; inflating a plurality of smaller rectangular prism bladders; placing the plurality of smaller rectangular prism bladders in the boat; inflating a bow bladder, placing the bow bladder in the bow of the boat; and covering the boat with a cover, wherein the cover is supported by the inflated bladders. The bow bladder is a conical bladder, trapezoidal prism, or pie slice bladder. The method further comprises the steps of inflating a plurality of spherical bladders; and placing the spherical bladders in the boat before covering the boat with the cover.

As used herein, the term boat includes a wide variety of watercraft, including without limitation vessels that can be lifted out of the water; the terms cone or conical refer to a three-dimensional geometric shape that tapers smoothly from a flat base to a point, where a cone with a polygonal base is a pyramid, and where the base of the cone may be, among other shapes, a half circle.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
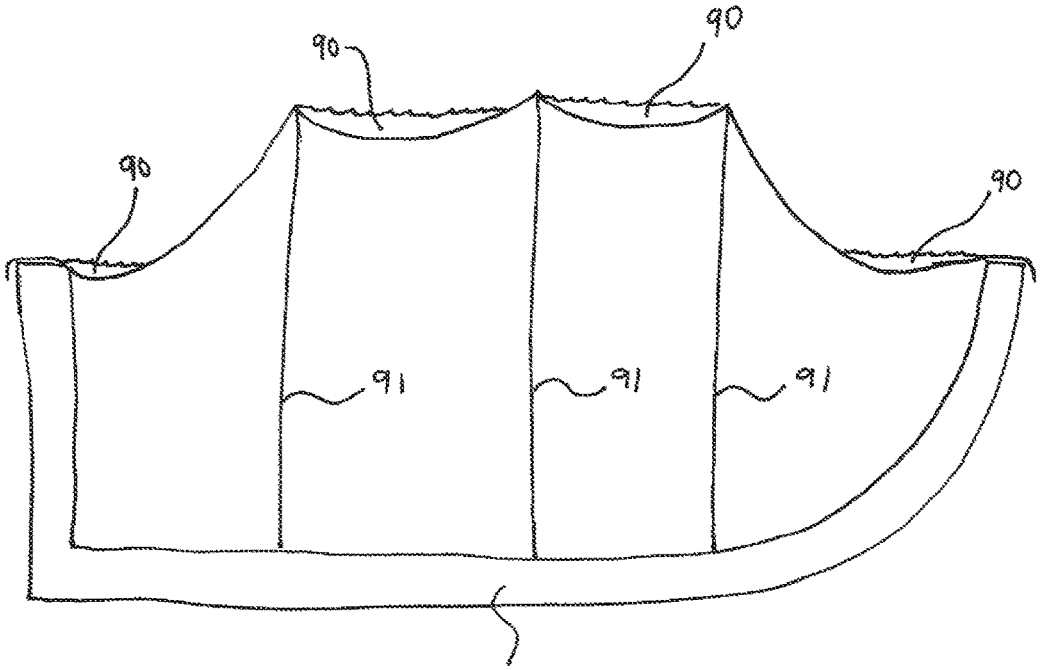
Prior Art Fig. 1
FIG. 1 is a cutaway side view of a prior art cover system.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a cutaway side view of a prior art cover system. A boat 10 has a plurality of support members 91 secured thereto. These support members 91 support a cover 20. If the cover is not drawn sufficiently tight over the support members 91 and boat 10, water 90 can pool and collect, thereby causing the cover 20 to sag in the gap between support members 91 and the boat 10. The weight of the water 90 on the cover 20 can cause the support members 91 to puncture through the cover 20, thereby allowing water 90 to flow through the cover and into the boat 10.

In a particular embodiment of the current invention, there are a plurality separate inflatable spherically shaped bladders that fill the volumetric space within the boat and support the cover. Since there are many spherical bladders that support the cover, there is less pressure applied by each spherical bladder on the cover thereby lessening, if not completely eliminating, the chance of puncturing the cover. Furthermore, since the gap between each of the bladders is relatively small, there is little if any chance of water and/or snow pooling between the bladders.

Figure 2:
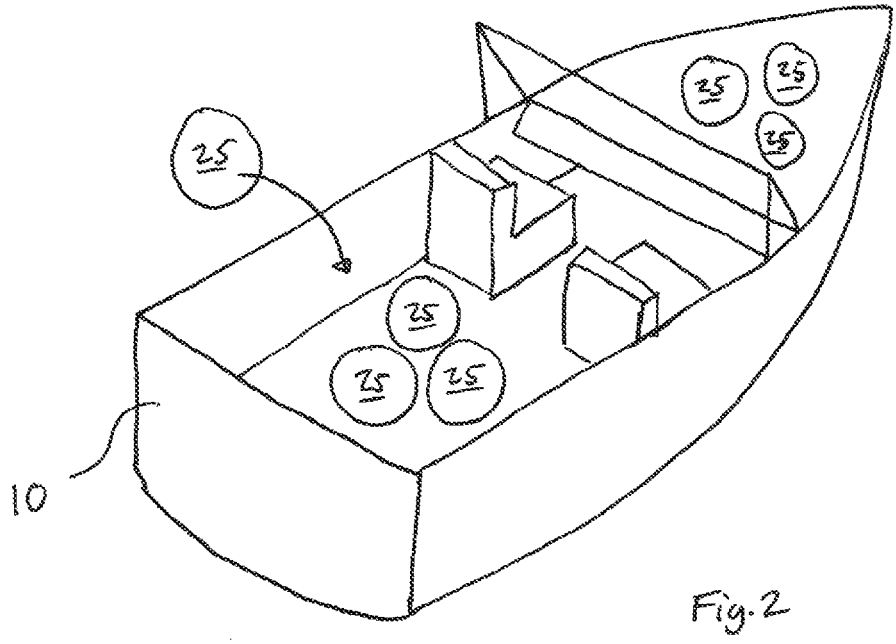
FIG. 2 is a perspective view of a boat with inflatable bladders being added thereto according to selected embodiments of the current disclosure.

FIG. 2 is a perspective view of a boat with inflatable bladders being added thereto according to selected embodiments of the current disclosure. Boats may have many different structural features, such as chairs, consoles, engine compartments, dashes, and windshields, that create a unique three-dimensional space within the boundaries of the boat. Inflatable bladders, especially ones of various sizes, can be used to fill the volumetric space within the boat. As shown in this figure, multiple inflated bladders 25 are placed within the volumetric space of the boat 10.

Figure 3:
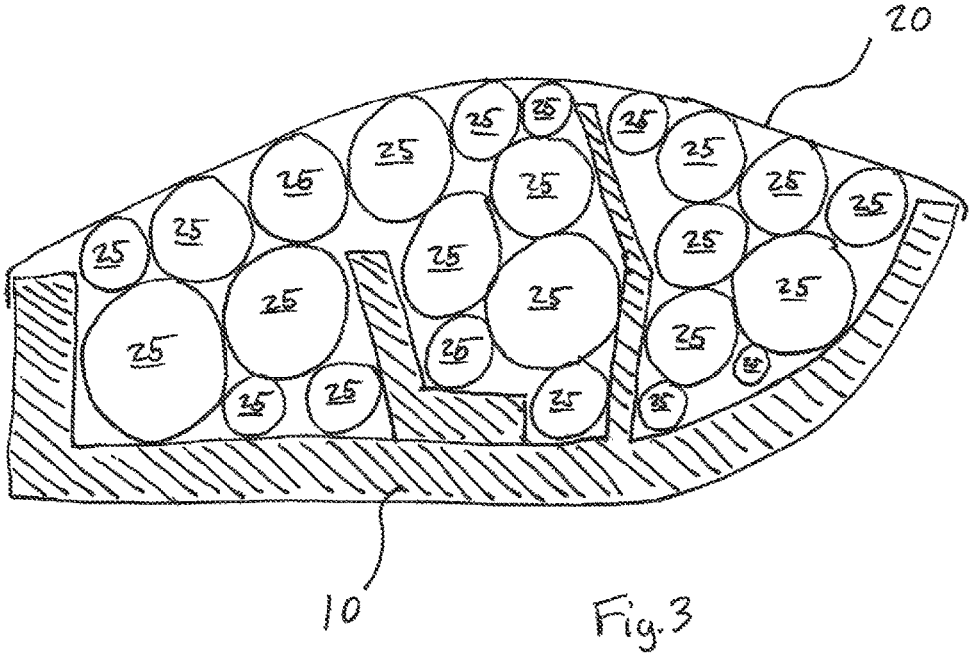
FIG. 3 is a cutaway side view of a boat utilizing a cover system according to selected embodiments of the current disclosure.

FIG. 3 is a cutaway side view of a boat utilizing a cover system according to selected embodiments of the current disclosure. The inflatable bladders 25 are within the volumetric space of the boat and provide support for a cover 20 placed over the boat 10. Since the cover 20 is supported at so many points by the inflatable bladders, the pressure at each of those support points is lower than with other prior art support systems. This reduces the chance of rupturing the cover. As is also shown in this figure, a more consistent slope is possible by adding and placing sufficient bladders to reduce and/or eliminate the pooling of snow, water, and other incident substances.

Figure 4:
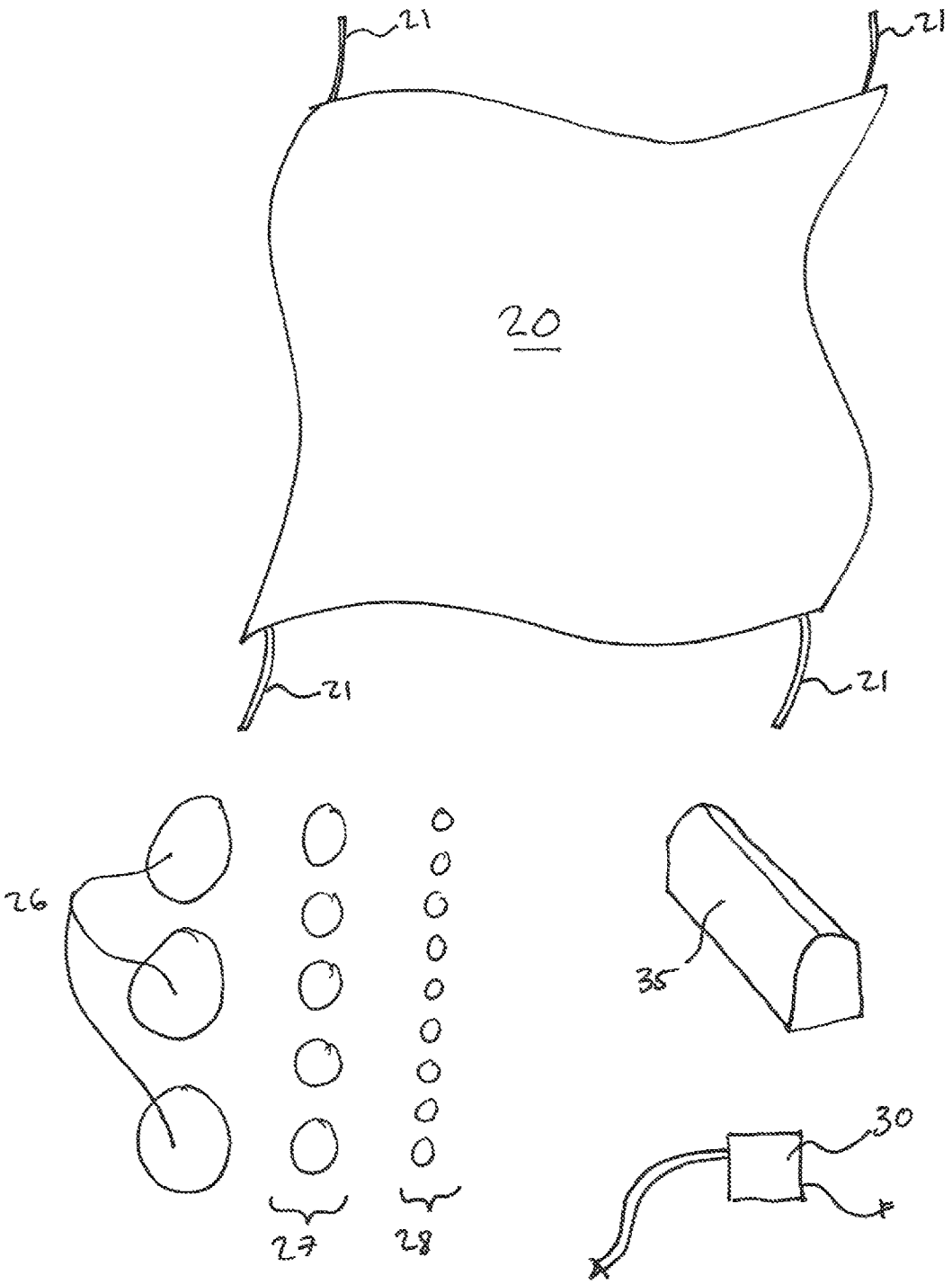
FIG. 4 is a schematic view of various components of a cover system according to selected embodiments of the current disclosure.

FIG. 4 is a schematic view of various components of a cover system according to selected embodiments of the current disclosure. The cover system includes a plurality of bladders 25. These bladders 25 can be the same size, or different sizes, such as large 26, medium 27, and small 28. Alternatively, each inflatable bladder can be made of an elastic material, explained in more detail below, that allows for the size of the bladder to be varied depending upon the pressure of air within the inflatable bladder. To inflate each bladder, a pump 30 may be included with the system. The pump 30 may be manually operated, such that a user must manually operate a compressor and valve system to create pressurized air to fill each bladder. In an alternative embodiment, the pump 30 may include an electric or combustion motor to drive the air compressor to create pressurized air to fill each bladder. A cover 20 is also provided with the cover system. In a particular embodiment, the cover 20 includes straps 21 to help secure the cover 20 to a boat. A carrying case holds the deflated bladders 25, cover 20, and pump 30.

To cover a boat or other vessel or object, a user may remove the bladders, cover, and pump from the carrying case. The user then inflates one or more of the bladders. If the bladder has a variable diameter, the user inflates the bladder to the desired size. After inflating the bladder, the bladder is placed within the volumetric space of the boat. The user repeats this process until the boat is filled with inflated bladders. Then, the cover is placed over the boat and inflated bladders. The cover is supported by the plurality of inflated bladders and resists pooling of rain and snow. Straps may be used to secure the cover to the boat to prevent it from coming loose from the boat and inflated bladders coming out of the boat. The boat can then be stored for a period of time, such as during the winter.

In certain situations, the bladders may settle within the volumetric space of the boat, thereby producing certain areas or spaces with a void that fails to properly support the cover and could result in the pooling of water. The present cover system enables users to account for this scenario, whereby the cover may be removed and one or more additional bladders are inflated and placed to fill the void. The cover is then placed back over the inflated bladders, including the additionally placed bladders.

In other situations, too many bladders are placed within the volumetric space of the boat. Users may remove the cover and remove one or more of the bladders to create a more appropriate support for the cover. The bladders may be deflated and stored for use in the future. The cover is then placed back over the boat and remaining inflated bladders for storage. In yet other situations, the bladders need to be repositioned within the volumetric space of the boat, wherein the user may remove the cover, reposition the inflatable bladders, and then replace the cover.

After storing the boat for a period of time, the cover may be removed to once again provide access to and use of the boat. To remove the cover from the boat, any straps that have been secured should be removed. The cover is then removed. The inflatable bladders are removed from the boat and deflated. The cover, inflatable bladders, and the pump are then stored within a carrying case.

In a particular embodiment, the cover is made from a water resistant, sturdy, and lightweight material such as nylon, canvas or plastic. The inflatable bladders are made from soft, non-abrasive plastic, elastic, or rubberized materials. As discussed above, the bladders may be different sizes. Alternatively, or in addition to, the bladders are made from an elastic material, similar to that used for exercise balls, that enables the diameter of the bladder to change depending upon the pressure present within the bladder. As the pressure increases, so does the diameter of the bladder. In this manner, a plurality of identical inflatable bladders may be provided, and the user inflates each bladder to its desired size to meet the requirements of each boat. In another embodiment, each inflatable bladder is similar to a beach ball, wherein the diameter is relatively fixed once inflated and regardless of the air pressure therein. The carrying case is made from nylon, canvas, or similar materials.

Figure 5:
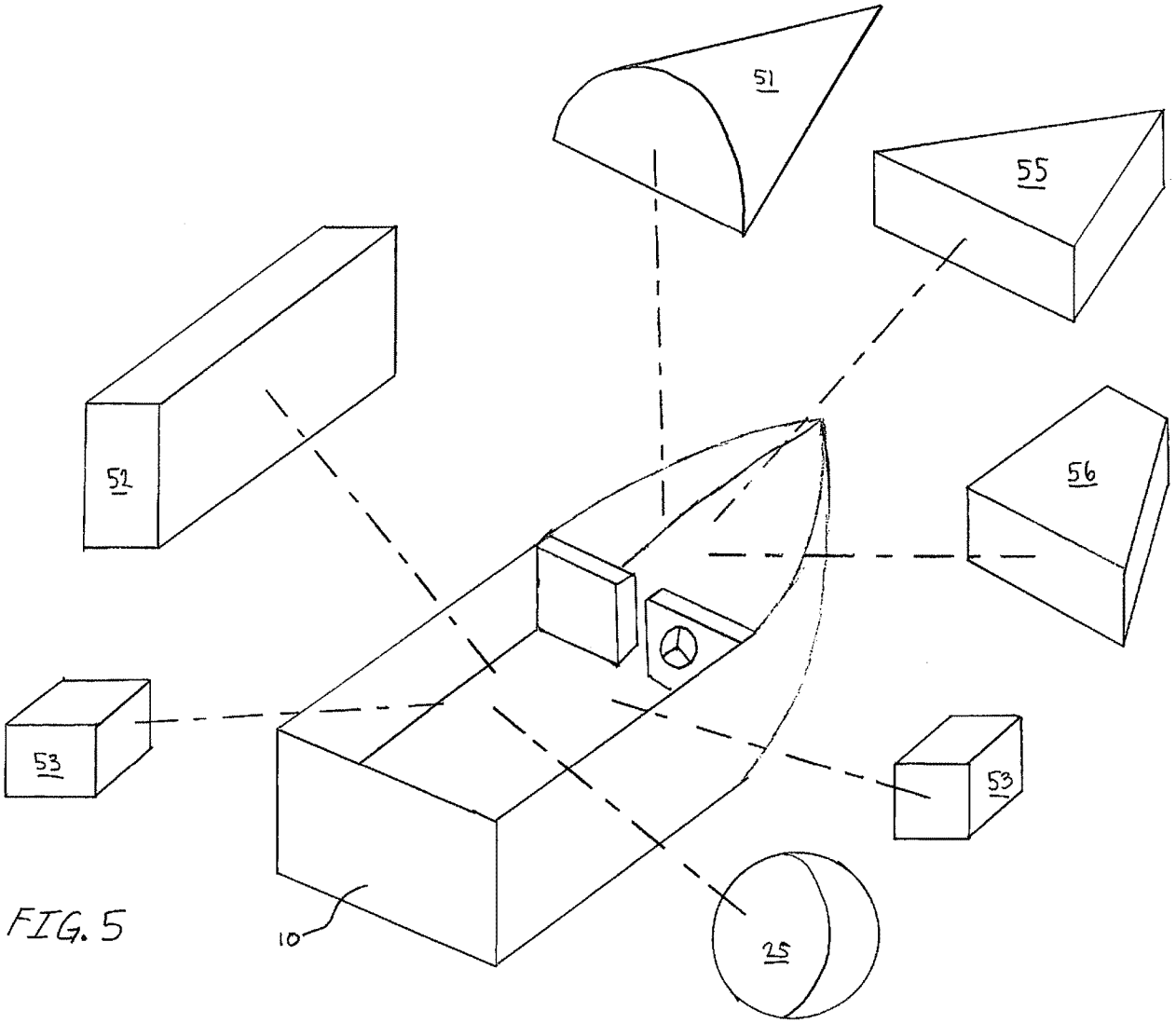
FIG. 5 is an exploded view of a boat utilizing a cover system according to selected embodiments of the current disclosure.

FIG. 5 is an exploded view of a boat utilizing a cover system according to selected embodiments of the current disclosure. Multiple bladders of different shapes and sizes are used to support the cover over a boat. A rectangular prism or cuboid bladder 52 is placed in the center of the boat 10. At the front or bow of the boat 10, a conical or pyramidal bladder 51 supports the cover as it slopes downwards from the middle of the boat to the front of the boat. A plurality of smaller rectangular prism or cuboid bladders 53, and in particular embodiments, four rectangular prism or cubic bladders 53 are placed on seats within the boat. The top surface of the smaller rectangular prism bladders 53 should be lower than the top surface of the rectangular prism 52 such that a cover placed thereon slopes downward from the rectangular prism 52.

In addition to the rectangular prism bladder 52, the conical bladder 51, and the plurality of smaller rectangular prism bladders 53, a plurality of spherical bladders 25 are also included with the cover system. As discussed above, these bladders may be fixed in diameter, or may have a variable diameter based upon the pressure to which each is inflated. The spherical bladders 25 are placed in gaps or other open areas within the boat and between the other bladders to provide additional support.

Once all of the bladders are appropriately positioned, a cover is placed over the boat and bladders. The bladders support the cover such that it slopes downward from the middle section of the boat to the edges without bowing or sagging. Since the cover is always sloping downwards from the middle to the edges of the boat, water, snow, and other materials or substances cannot pool on the cover. The boat may then be stored without fear that snow or ice will pool in depressions on the cover.

After storing the boat for a period of time, the boat is removed from storage, and the cover removed. The inflatable bladders are removed from the boat and deflated. The cover and deflated bladders are then stored within a carrying case until the boat is stored once again.

The conical bladder discussed above is a bow bladder, that is, a bladder that is placed in the bow of a boat. In alternative embodiments, the bow bladder is a "pie-slice" shaped bladder 55, wherein the bladder resembles a slice of pie. It includes a back wall, and two side walls that meet at a point. The top of the pie-slice bladder 55 has a downward slope from the back wall to the point that the two side walls meet, where the downward slip is sufficient to prevent pooling of water, snow, or other materials of the cover placed thereon.

In other embodiments, the bow bladder is a trapezoidal prism 56. Like the pie-sliced bladder 55, it has a back wall and two side walls, but also includes a front wall. The width of the front wall is less than the width of the back wall. The top of the trapezoidal prism 56 has a downward slope from the back wall to the front wall.

Each of the bladders is a separate volumetric space and is not in fluid connection with another bladder. This allows for the bladders to be rearranged and placed within unique boat configurations. While each bladder must be inflated separately, it provides for a cover system that is adaptable to a wide assortment of boats.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

That which is claimed:

1. A method of storing a boat comprising the steps of inflating a plurality of inflatable bladders, wherein each of the plurality of inflatable bladders is spherical in shape;

placing the plurality of spherical inflatable bladders within a volumetric space of the boat;

inflating a trapezoidal prism bladder;

placing the trapezoidal prism bladder in the bow of the boat covering the boat with a cover, wherein the cover is supported by the plurality of spherical inflatable bladders and the trapezoidal prism bladder;

storing the vessel for a period of time;

removing the cover from the boat;

removing the plurality of spherical inflatable bladders and the trapezoidal prism bladder from within the volumetric space of the boat;

deflating the plurality of spherical inflatable bladders and the trapezoidal prism bladder; and placing the cover, plurality of spherical inflatable bladders, and the trapezoidal prism bladder within a carrying case.

2. The method of claim 1, where the plurality of spherical inflatable bladders comprises bladders of at least two sizes, where each size inflates to a different diameter.

3. The method of claim 1, where the plurality of spherical inflatable bladders consists of bladders with variable diameters, where the diameter of a bladder varies with the pressure within the bladder.

4. The method of claim 1, further comprising the steps of inflating a rectangular prism bladder; and placing the rectangular prism bladder in the middle of the boat before the step of covering the boat with a cover.

5. The method of claim 1, further comprising the steps of inflating a plurality of rectangular prism bladders; and placing the plurality of rectangular prism bladders in the boat before the step of covering the boat with a cover.

6. The method of claim 5, wherein each of the plurality of rectangular prism bladders are placed on seats within the boat.

7. The method of claim 1, wherein each of the plurality of spherical inflatable bladders is inflated separately.

8. A method of storing a boat comprising the steps of inflating a rectangular prism bladder;

placing the rectangular prism bladder in the middle of the boat;

inflating a plurality of smaller rectangular prism bladders;

placing the plurality of smaller rectangular prism bladders in the boat;

inflating a bow bladder, where the bow bladder has a shape selected from the group consisting of a cone, a trapezoidal prism, and a pie-slice;

placing the bow bladder in the bow of the boat;

covering the boat with a cover, wherein the cover is supported by the inflated bladders.

9. The method of claim 8, further comprising the steps of inflating a plurality of spherical bladders; and placing the spherical bladders in the boat before covering the boat with the cover.

* * * * *